US006547126B2

(12) United States Patent
Freiborg et al.

(10) Patent No.: US 6,547,126 B2
(45) Date of Patent: Apr. 15, 2003

(54) PACKAGING BOX WITH FIXED PARTITIONS

(75) Inventors: Mark L. Freiborg, Huntington Beach, CA (US); Bennie Freiborg, Flintridge, CA (US)

(73) Assignee: The Dorothy and Ben Freiborg 1980 Trust, Flintridge, CA (US)

( * ) Notice: Subject to any disclaimer, the term of this patent is extended or adjusted under 35 U.S.C. 154(b) by 0 days.

(21) Appl. No.: 09/886,584

(22) Filed: Jun. 21, 2001

(65) Prior Publication Data

US 2002/0195482 A1 Dec. 26, 2002

(51) Int. Cl.[7] ..... B65D 5/48; B65D 25/04

(52) U.S. Cl. ..... 229/120.17; 206/323; 229/120.18; 229/120.24; 229/120.26; 229/120.29

(58) Field of Search ..... 229/120.17, 120.18, 229/120.23, 120.24, 120.26, 120.28, 120.29, 120.35, 120.38; 206/323, 324, 499, 526

(56) References Cited

U.S. PATENT DOCUMENTS

| | | | | | |
|---|---|---|---|---|---|
| 558,423 | A | | 4/1896 | Schenck | |
| 1,475,983 | A | * | 12/1923 | Casey | 229/120.29 |
| 1,808,922 | A | * | 6/1931 | Gallistel | 229/120.18 |
| 2,054,291 | A | * | 9/1936 | Lambert | 229/120.17 |
| 2,346,450 | A | | 4/1944 | Owen | |
| 2,605,039 | A | * | 7/1952 | Deline | 229/120.24 |
| 3,317,111 | A | * | 5/1967 | Black | 229/120.26 |
| 3,467,249 | A | | 9/1969 | Calvert | |
| 3,487,479 | A | * | 1/1970 | Grooms | 229/120.24 |
| 4,376,507 | A | * | 3/1983 | Nauheimer | 229/120.24 |
| 4,379,518 | A | * | 4/1983 | Taylor, Sr. | 229/120.24 |
| 4,396,145 | A | * | 8/1983 | Ditton | 229/120.17 |
| 4,396,146 | A | * | 8/1983 | Sieffert | 229/120.18 |
| 4,714,643 | A | | 12/1987 | Kuenzel | |
| 4,753,341 | A | * | 6/1988 | McIntyre | 229/120.38 |
| 4,955,502 | A | * | 9/1990 | Sorci | 229/120.24 |
| 5,027,946 | A | | 7/1991 | Parsons | |
| 5,615,767 | A | | 4/1997 | Eull et al. | |
| 5,651,464 | A | | 7/1997 | Weber | |
| 6,244,502 | B1 | * | 6/2001 | Hollar et al. | 229/120.29 |

* cited by examiner

*Primary Examiner*—Gary E. Elkins
(74) *Attorney, Agent, or Firm*—Blakely, Sokoloff, Taylor & Zafman LLP

(57) ABSTRACT

A partition for a packaging box having a bottom, two opposing sides, and two opposing ends. The partition includes four panels. The first panel is located between and substantially parallel to the ends, between and substantially perpendicular to the sides, and substantially perpendicular to the bottom. The second panel is joined to the box and joined to the first panel along a first fold line. The third panel is located immediately adjacent the first panel. The fourth panel is joined to the third panel along a second fold line that is substantially perpendicular to the first fold line.

19 Claims, 7 Drawing Sheets

PACKAGING BOX WITH FIXED PARTITIONS

BACKGROUND OF THE INVENTION

Packaging boxes are sometimes fitted with internal partitions to allow packaging of items side by side with lateral support and separation between adjacent items. Partitions may take the form of a vertical panel, such a rectangle of corrugated cardboard, placed between adjacent items. More elaborate partitions may take the form of a "collar," such as a strip of corrugated cardboard folded to form a shape that partially or completely surrounds the items.

It is an object of packaging boxes to protect the packaged items during storage and shipping. A packaging box may be placed in virtually any orientation, particularly when handled during shipping. If the packaged items are heavy, items packaged side by side can slide and damage adjacent items if not separated by partitions that can support and hold the adjacent items when the packaging box is oriented such that the partitions support the items against gravity and shock loads.

As an example, asphalt composition roofing ridge covers that are shipped in a folded configuration that allows the ridge covers to be installed with minimal bending are a heavy item that can be damaged if adjacent ridges slide together while packaged. An exemplary ridge cover of this type is described in U.S. Pat. No. 6,182,400 which is incorporated herein by reference. The ridge covers may be advantageously packaged by placing several adjacent stacks of ridge covers into a packaging box with the stacks separated and supported by partitions. The ridge covers are somewhat heavy. A single stack of ridge covers may weigh about 15 pounds. The packaged ridge covers are typically delivered to a rooftop. As the packaged ridge covers are transported to the rooftop, they may be handled roughly and put into virtually any possible orientation. The ridge covers are particularly susceptible to damage from lateral shifting because it will tend to further fold the covers and cause cracking along the centerline fold, which forms the ridgeline of the ridge cover.

It is desirable to provide a packaging box with fixed partitions that can separate and support adjacent items that are heavy to prevent damage to the items during storage, shipping, and rough handling regardless of the packaging orientation.

SUMMARY OF THE INVENTION

A partition for a packaging box having a bottom, two opposing sides, and two opposing ends. The partition includes four panels. The first panel is located between and substantially parallel to the ends, between and substantially perpendicular to the sides, and substantially perpendicular to the bottom. The second panel is joined to the box and joined to the first panel along a first fold line. The third panel is located immediately adjacent the first panel. The fourth panel is joined to the third panel along a second fold line that is substantially perpendicular to the first fold line.

DETAILED DESCRIPTION OF THE INVENTION

The panels of any of the described embodiments may be formed from separate sheets of material and joined by various means such as taped or lap and glue joints. The fold lines may be folds in a single sheet of material to form various panels or folds along joints between separate sheets of material. The panels may be formed from more than one sheet of co-planar material that may or may not be joined together. Panels are described as though they were 2-dimensional planes corresponding to the mid-plane between the two opposing major surfaces. Terms are qualified by "substantially" to mean that the term is to be applied within the normal tolerances of the packaging industry. For example, "substantially perpendicular" would mean at a ninety degree angle plus or minus an appropriate angular tolerance.

Figure 2:
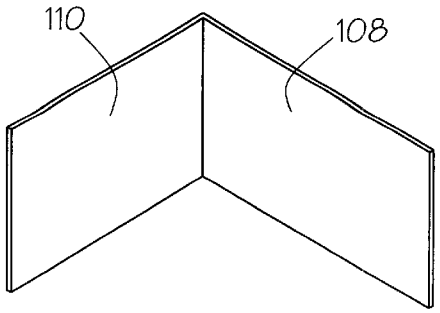
FIG. 2 is a perspective drawing of the partition insert shown in FIG. 1.
Figure 1:
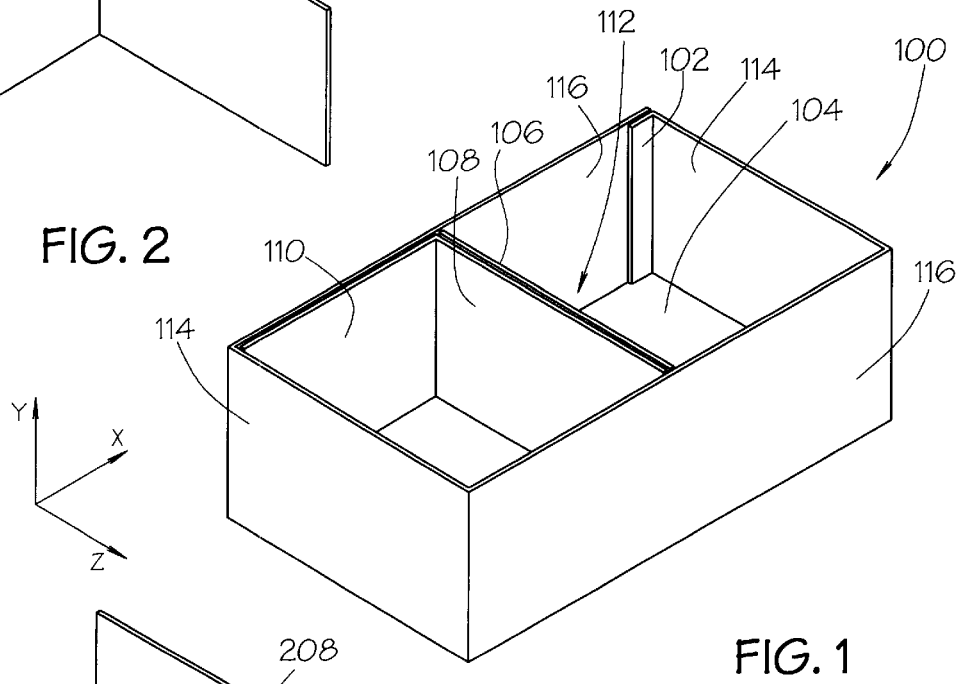
FIG. 1 is a perspective drawing of an embodiment of a packaging box with a fixed partition according to the present invention.

FIG. 1 shows an embodiment of a packaging box 100 with a partition 112 according to the present invention. The box 100 may be formed by folding a piece of corrugated cardboard with an overlapping portion 102 that is glued or stapled or otherwise fastened together. The bottom 104 of the box may be formed by folding panels from the sides of the box inward meeting along a midline of the bottom. Such a box bottom may be doubled with a first set of panels folding inward from one pair of opposing sides and then covered by a second pair of panels folding inward from the remaining two opposite sides. The box construction described is well known to those skilled in the art and other forms of box construction may also be used with the present invention.

The partition 112 of the present invention is formed by extending a first partition panel 106 from a panel of the box and then adding a second partition panel 108 that may or may not be connected to other panels of the box. In the embodiment shown in FIG. 1, the first partition panel 106 extends from and is folded up from one of the bottom panels 104 of the box along a first fold line. The first panel 106 is located between and substantially parallel to the ends 114, between and substantially perpendicular to the sides 116, and substantially perpendicular to the bottom 104. The box 100, including the first 106 and second 108 panels, may be formed from a single sheet of material.

The second partition panel 108 may be part of a separate partition assembly. The assembly comprises the second partition panel 108 joined to a second panel 110. The assembly fits within one of the compartments formed by the first partition panel 106. It is shown in the left compartment in FIG. 1. It will be appreciated that panel 110 of the second partition panel assembly could be attached to or extend from a panel of the packaging box 100.

It is significant that the first partition panel 106 is joined to another panel along a first axis and the second partition panel 108 is joined to a panel along a second axis that is perpendicular to the first axis. XYZ axes are shown in FIG. 1 to allow identification of these axes in the figure. In the embodiment shown in FIG. 1, the first partition panel 106 is joined to a panel of the box bottom along the Z axis. The second partition panel 108 is joined to a second panel 110 of the partition assembly along the Y axis. The first partition panel 106 is free to rotate about the first fold line along the Z axis and the second partition panel 108 is free to rotate about the second fold line along the Y axis. However, when surfaces of the two partition panels are placed adjacent one another and held in close proximity, such as by items packed in the box 100, the two partition panels act cooperatively to prevent each other from rotating about their respective fold lines and the result is a fixed partition 112 that is capable of supporting items packed within the box even if the packaging box is on end so that the full weight of the contained items is supported by the partition assembly. It will be appreciated that when a loose partition assembly 108, 110 is used, the top closure (not shown) will act to hold the loose partition assembly in place and prevent rotation around the Z axis.

The first partition panel 106 provides a first partition means for partitioning the box at a fixed position along a first fixed edge of the first partition means. The second partition panel 106 provides a second partition means for partitioning the box at a fixed position along a second fixed edge of the second partition means, the second fixed edge being substantially perpendicular to the first fixed edge. The edge are fixed by being coupled to the box. The first and second fixed edges define the plane of the fixed partition assembly.

Figure 3:
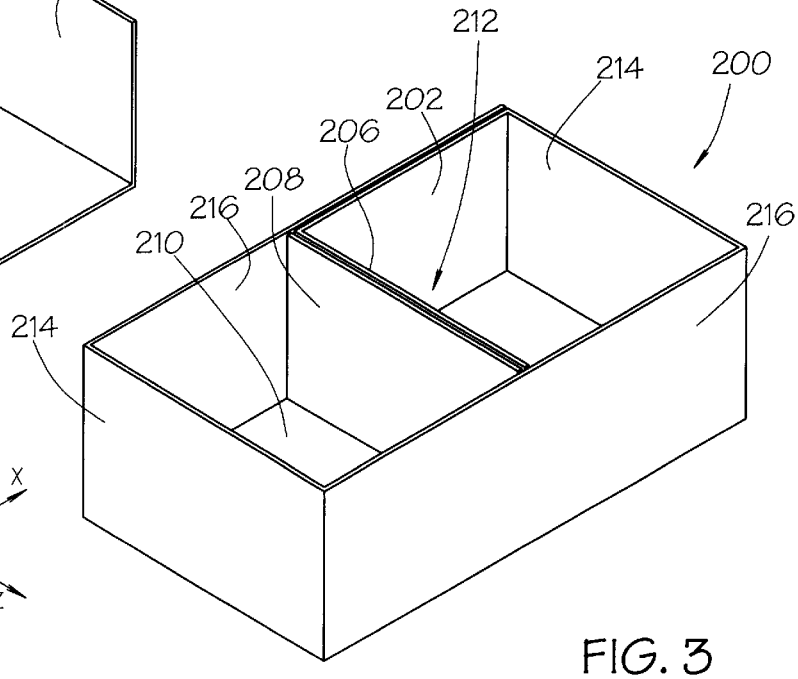
FIG. 3 is a perspective drawing of another embodiment of a packaging box with a fixed partition according to the present invention.

FIG. 3 shows another embodiment of a packaging box 200 with a partition panel 212 according to the present invention. A first partition panel 206 is joined along a first fold line to a side panel 202 which is connected to the packaging box. The side panel 202 corresponds to the overlapping portion 102 of packaging box 100 shown in FIG. 1. The first panel 206 is located between and substantially parallel to the ends 214, between and substantially perpendicular to the sides 216, and substantially perpendicular to the bottom 204.

Figure 4:
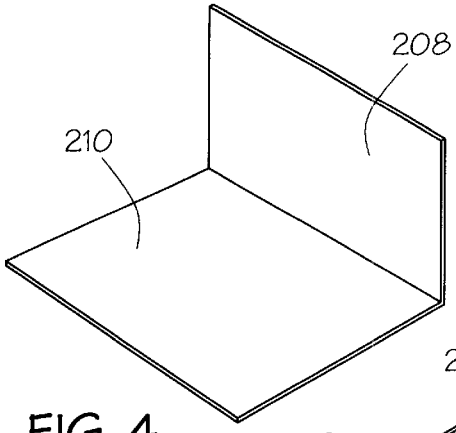
FIG. 4 is a perspective drawing of the partition insert shown in FIG. 2.

A second partition panel 208 is connected to a bottom panel 210 to form a separate partition assembly as shown in FIG. 4. The assembly is inserted in a compartment of the box formed by the first partition panel 206. FIG. 3 shows the assembly inserted in the compartment at the front left of the figure. As in the first embodiment, the first partition panel 206 and the second partition panel 208 act cooperatively to form a fixed partition 212 in the packaging box 200. In this case, the first partition panel 206 can rotate around the Y axis and the second partition panel 208 can rotate around the Z axis.

The partition of the present invention can be used advantageously with packaging boxes formed by wrapping end panels around tabs that extend from side panels to lock the four sides of the box into a rigid assembly. This type of packaging box forms a strong box without the need for adhesives or fasteners. This basic box construction is well known to those of ordinary skill in the art.

Figure 5:
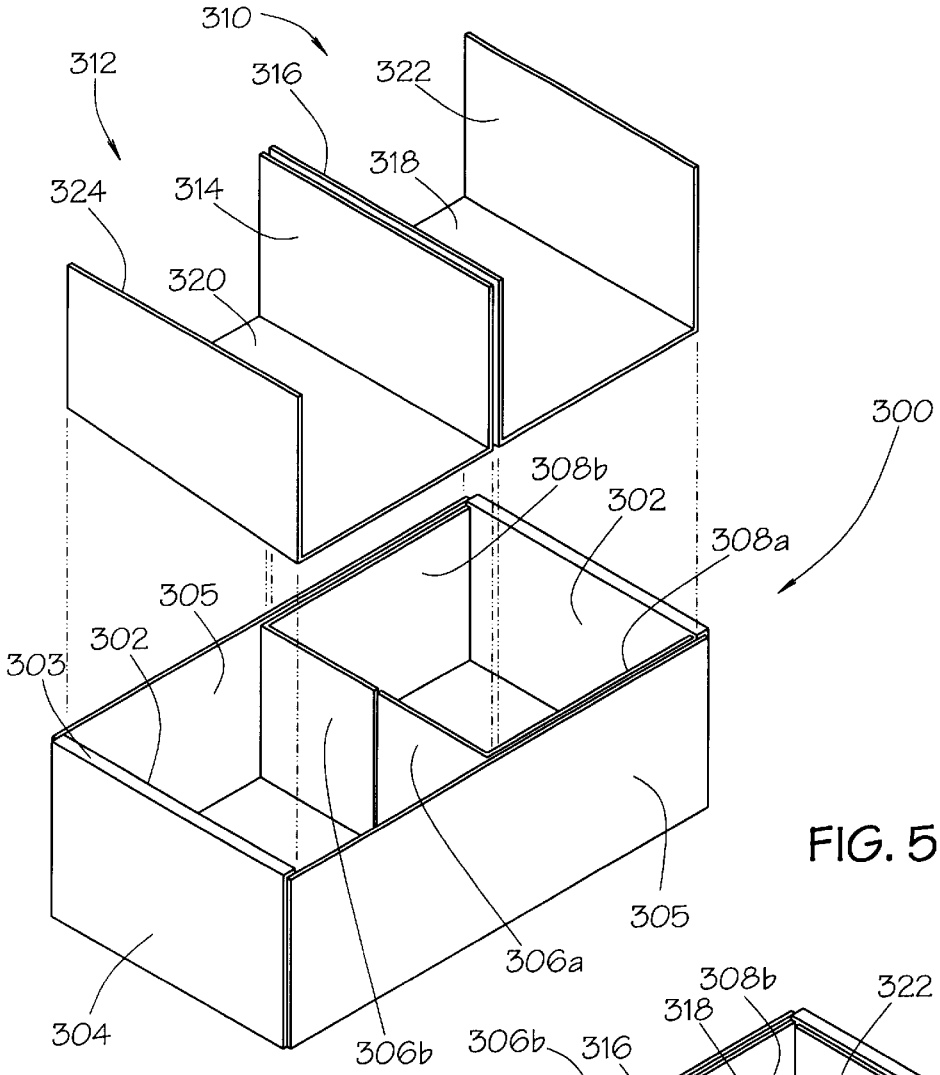
FIG. 5 is an exploded view of another embodiment of a packaging box with a fixed partition according to the present invention.

FIG. 5 shows an embodiment of the partition of the present invention in a box of this type of construction. End panels 302, 303, 304 wrap around panels (not visible) that extend from opposing sides 305 to form the packaging box 300. In the embodiment shown, the first partition panel is formed from two panels 306*a*, 306*b*. Each of these panels is connected to a side panel 308*a*, 308*b*. The side panels are in turn connected to the end panel 302. In this embodiment, two substantially similar separate partition assemblies 310, 312 are used in cooperation with the first partition panels 306*a*, 306*b*. Each of the partition assemblies has a partition panel 314, 316 connected to a bottom panel 318, 320. The partition assemblies further have an outside panel 322, 324. The two loose partition assemblies 310, 312 are functionally similar to the loose partition assembly of the embodiment shown in FIG. 3. However, by providing partition panels on both sides of the first partition panels 306*a*, 306*b* and by providing outside panels 322, 324, the partition 326 is of even greater strength than that shown in the earlier embodiments. In this embodiment, the two panels 306*a*, 306*b* that make up the first partition panel each rotates about a different fold line each of which is in the Y direction. When the two panels 306*a*, 306*b* that make up the first partition panel are held together by the second and third partition panels 314, 316, the first partition panel is fixed in place because there is no common axes of rotation for the two panels 306*a*, 306*b*.

Figure 6:
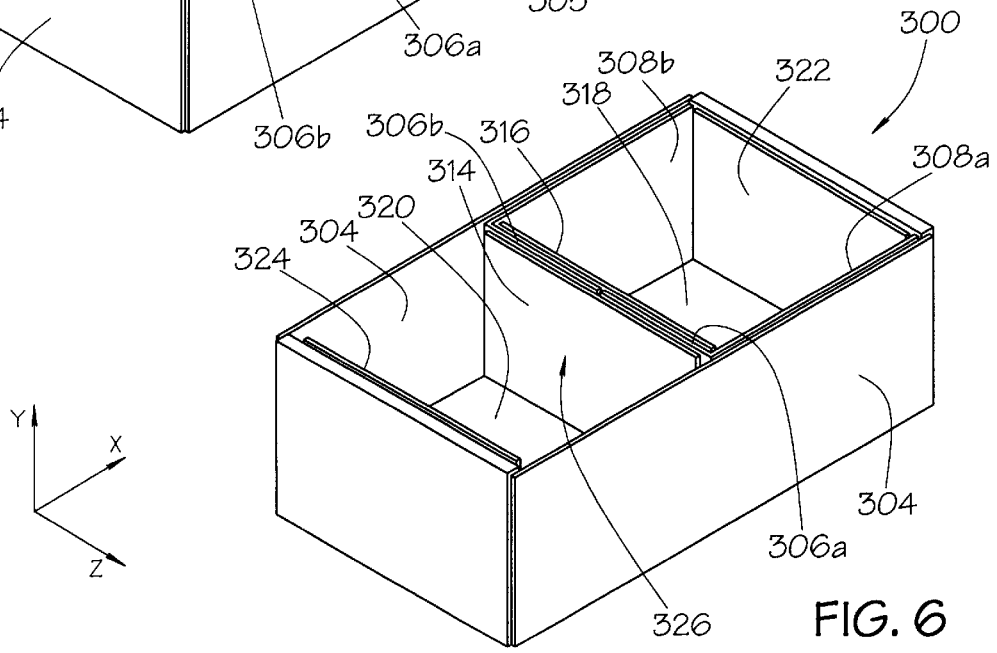
FIG. 6 is a perspective drawing of the assembled packaging box of FIG. 5.

FIG. 6 shows the packaging box 300 with the loose partition panels 310, 312 in place. It may be observed that the partition 326 consists of three layers of panels with the center first partition panel 306*a*, 306*b* being joined to the packaging box at both ends. This forms an extremely strong partition panel 326 which not only provides good lateral support for packaged items but also provides additional crush resistance for the box when stacked in the Y direction.

The two panels 306*a*, 306*b* that make up the first partition panel provide a first partition means for partitioning the box at a fixed position along a fourth fixed edge opposite the first fixed edge of the first partition means. The second partition panel 314 provides a second partition means for partitioning the box at a fixed position along a second fixed edge of the second partition means, the second fixed edge being substantially perpendicular to the first fixed edge. The third partition panel 316 provides a third partition means for partitioning the box at a fixed position along a third fixed edge of the third partition means, the third fixed edge being substantially parallel to the second fixed edge. The third fixed edge is spaced apart from the second fixed by a distance such that one surface of each of the second and third partition panels is immediately adjacent each of the opposing surfaces of the first partition means. The edge are fixed by being coupled to the box. The first, second, third, and fourth fixed edges define the plane of the fixed partition assembly.

Figures 7, 8:
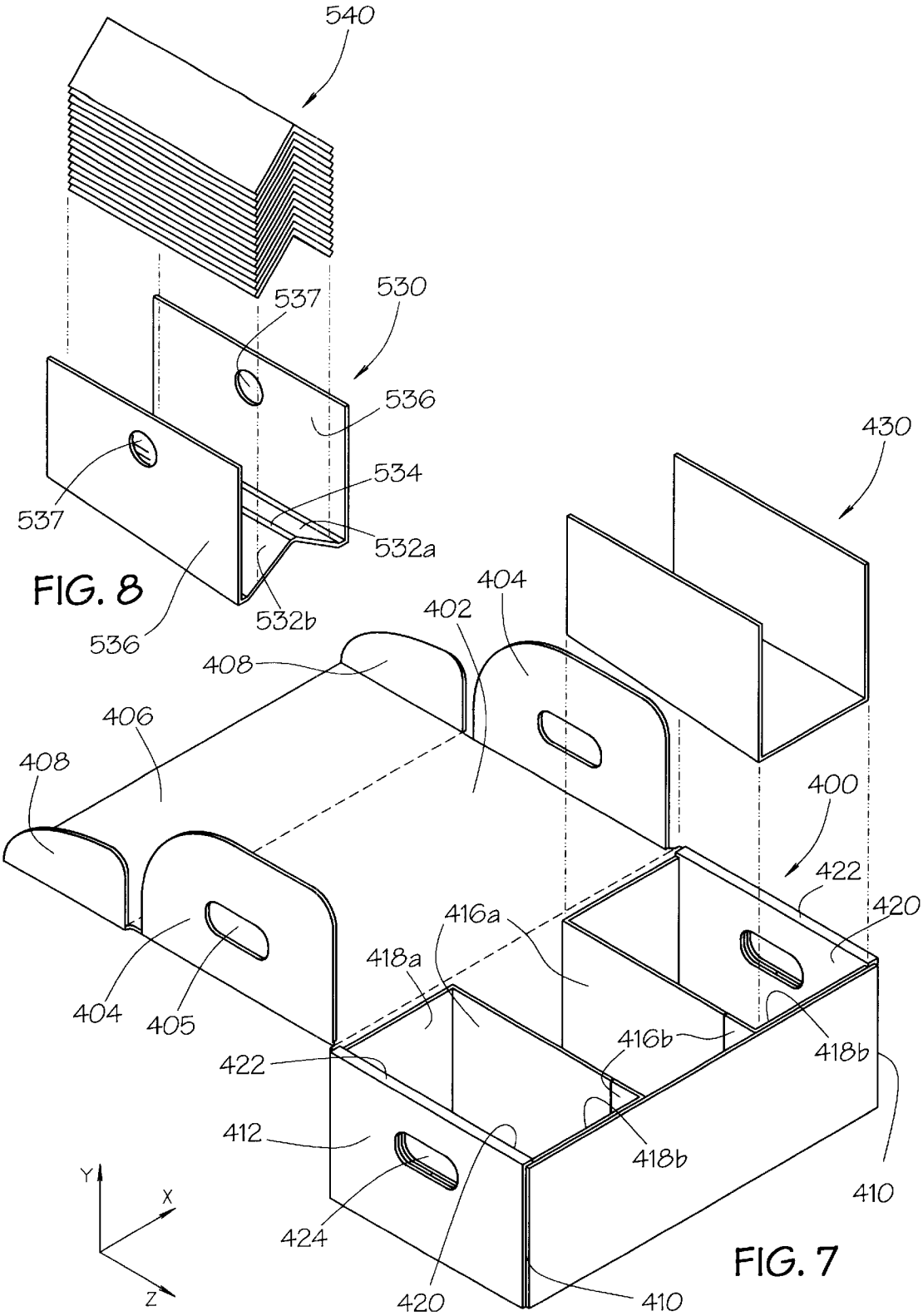
FIG. 7 is an exploded view of another embodiment of a packaging box with two fixed partitions according to the present invention.
FIG. 8 is a perspective drawing of an alternate embodiment for the partition insert shown in FIG. 7 with a stack of folded ridge covers.
Figure 9:
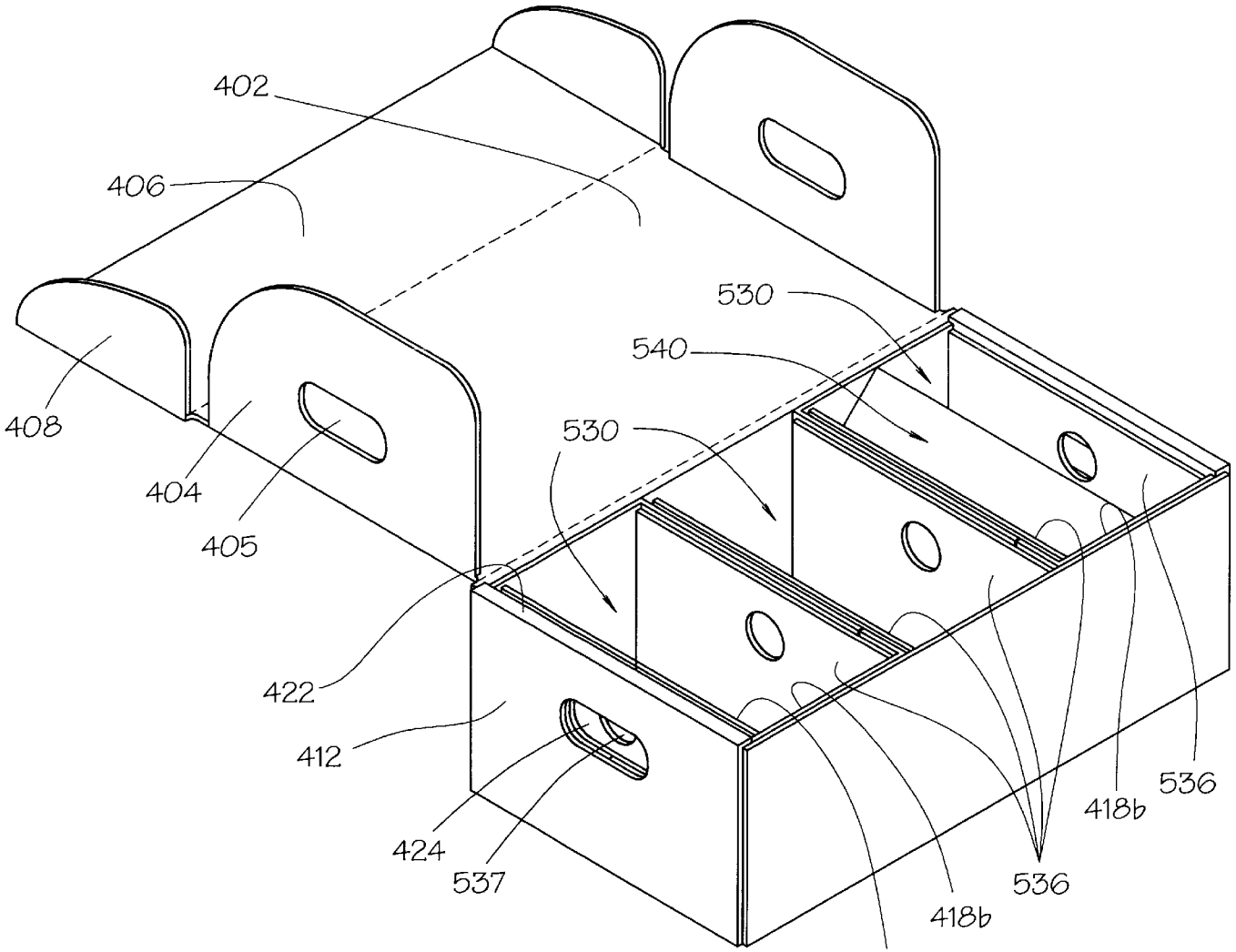
FIG. 9 is a perspective drawing of the assembled packaging box of FIG. 7 with the and a stack of folded ridge covers.

FIG. 7 shows another embodiment of a packaging box 400 that uses partition panels according to the present invention. The basic packaging box shown includes the wrapped side construction similar to the packaging box 300 shown in FIG. 6 and an integral top 402 with two top side panels 404 and a front panel 406 with two side locking tabs 408. The side locking tabs 408 can be inserted into pockets 410 formed by the end panels 412, 420, 422 that form the ends of the box. This basic box structure with integral locking lid is well known to those of ordinary skill in the art.

In the embodiment shown in FIG. 7, there are two partitions forming three compartments within the packaging box 400. Each of the partition panels is similar to the partition panel of the embodiment shown in FIG. 6. In the embodiment of FIG. 7, each of the first partition panels is formed from two panels 416A, 416B. Unlike the embodiment shown in FIG. 6, the two panels that form the first partition panel are of unequal sizes. This may be done to optimize the use of material that forms the box. Each of the panels that forms the first partition panel is connected to a side panel 418A, 418B and the two side panels are in turn connected to the end panel of the box 420.

The first partition panels of this embodiment divide the box into three compartments and three substantially identical loose partition assemblies 430 are inserted into each of the three compartments. These loose partition assemblies 430 function similarly to the loose partition assemblies 310, 312 shown in FIGS. 5 and 6.

If the packaging box 400 is to be used for packaging stacks of folded ridge covers 540, it is desirable to provide a ridge support means to support the ridge covers in their folded configuration. The ridge covers are substantially thicker at one end than the other. Preferably the ridge covers are stacked with the thick end at alternating ends of the stack so that the stack is substantially level. Such a ridge support means may be integrated as part of the partition assemblies as shown in FIG. 8. The flat bottom panel 432 can be replaced by two panels 532*a*, 532*b* that are folded along a ridge line 534 to provide an angle substantially similar to that of the ridge covers thereby supporting the folded ridge line of the ridge covers. It may be appreciated that the loose partition assemblies do not have to provide a lateral support for the first partition panel because the first partition panel is made of two sub-panels 416*a*, 416*b* joined at each end to the packaging box 400. The loose partition assemblies 430, 530 only have to cooperate with the first partition sub-panels 416*a*, 416*b* to hold the sub-panels substantially co-planar. By "locking" these sub-panels together they then fix the partition sub-panels in place relative to the box. Therefore, the folded bottom 532*a*, 532*b* of the partition assembly 530 does not compromise the lateral support of the partition.

Figure 10:
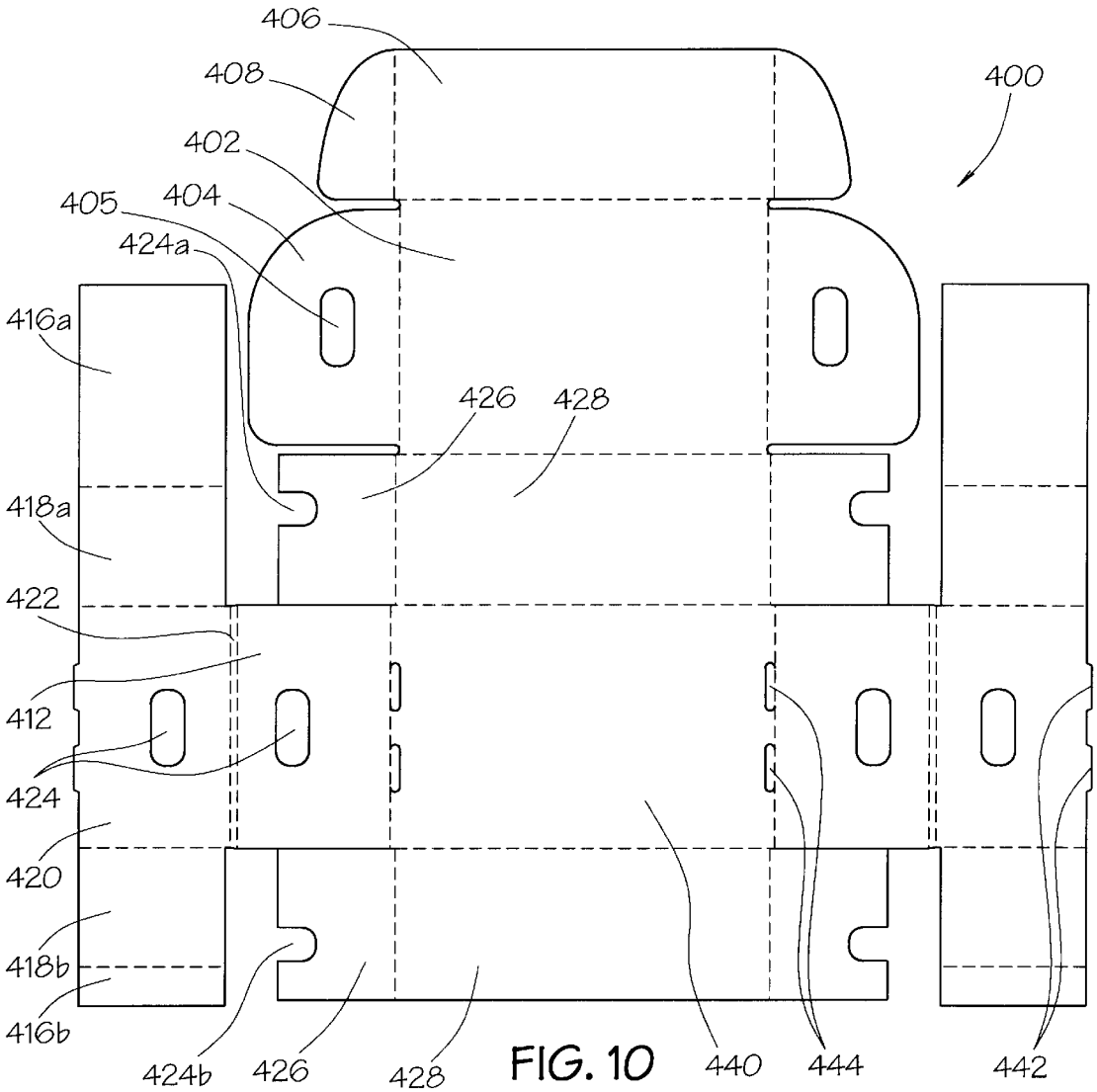
FIG. 10 is a plan view of the packaging box of FIG. 7 prior to folding.

FIG. 10 shows a plan for cutting and folding a single sheet of material to form a packaging box 400 with attached first partition panels 416*a*, 416*b*. In FIG. 10, dashed lines indicate fold lines. The box is symmetrical left to right and reference numerals have been applied to only one side for clarity. The sheet of material, preferably corrugated cardboard, may be die cut along the solid lines and scored along the dashed lines. The folding and locking construction of the box provides a box that is strong and rigid.

The box 400 is folded and assembled as follows. Locking corner panels 426 extending from the side panels 428 are folded to be substantially perpendicular to the side panels 428. The side panels 428 with attached corner panels 426 are folded to be substantially perpendicular to the bottom panel 440. The first end panels 412 are folded to be substantially perpendicular to the bottom panel 440 and adjacent to the corner panels 426. The second 422 and third 420 end panels are folded around the corner panels 426. Tabs 442 extending from the third end panel 420 engage slots 440 in the bottom 440 panel to lock the end panels 412, 422, 420 in place around the corner panels 426 and forming a pocket 410 between the first end panel 412 and the corner panels 426. Before folding the third end panel 420 down into the box, the partition support panels 418*a*, 418*b* with attached first partition sub-panels 416*a*, 416*b* are folded to be substantially perpendicular to the third end panel 420. The partition support panels 418*a*, 418*b* are adjacent the side panels 428 when the third end panel 420 is folded and locked into its assembled position. The first partition sub-panels 416*a*, 416*b* are folded to be substantially perpendicular to the partition support panels 418*a*, 418*b* and to the side panels 428. FIG. 7 shows the box 400 folded and ready to receive the partition assemblies 430, 530. The lid portion is shown as being folded back along line to be substantially perpendicular to the attached side panel 428.

Figure 11:
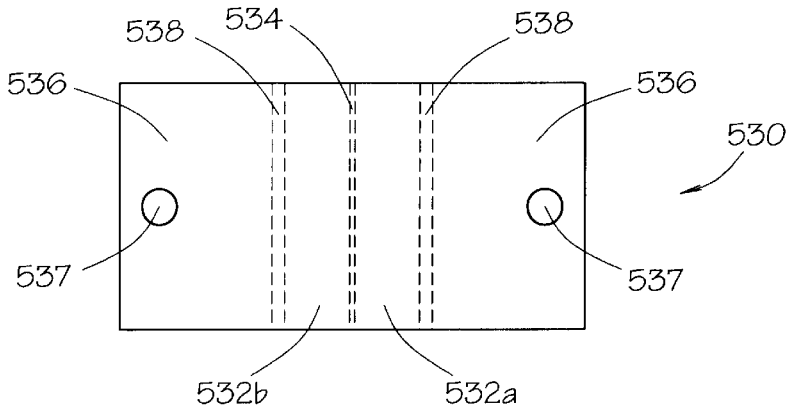
FIG. 11 is a plan view of the partition insert of FIG. 8 prior to folding.

FIG. 11 shows a plan view of an embodiment of the partition assembly 530 of FIG. 8 before folding. This embodiment of the partition assembly includes a ridge support structure for use in packaging stacks of folded asphalt composition ridge covers 540. The assembly preferably is formed from corrugated cardboard. The assembly 530 is cut along the solid lines and folded along the dashed lines to form bottom panels 538 that rest against the bottom 440 of the box 400. The assembly 530 is folded along the ridge line 534 to form a ridge support from the two support panels 532*a*, 532*b* to support the ridge covers in their formed shape. A double score may be used for the ridge line 534 as shown to provide a more rounded ridge support. The two end panels 536 are folded to be substantially perpendicular to the bottom panels 538.

The folded assembly 530 is placed in the box to complete the partitions. The two end panels 536 are substantially identical so that either panel may serve as a second partition panel. Both panels serve as a second partition panel for the assembly placed in the center compartment of the box 400. The direction of the corrugations in the first partition panels 416*a*, 416*b* are preferably perpendicular to the direction of corrugations in the end panels 536 to provide more stiffness in the partitions. It is also preferable that the corrugations of the assembly 530 be perpendicular to the ridge line 534 to provide more stiffness in the support panels 532*a*, 532*b* that support the ridge covers. Holes 537 may be provided in the end panels 536. These holes align with hand holes 424 in the end of the box 400 and allow the contents of the box to be observed.

When the box 400 has been filled with stacks of ridge covers 540, the top flaps 404 and the front flaps 408 of the box lid are folded up. The box lid is then closed over the ridge covers with the box top 402 forming the top of the box and the top flaps 404 inserted inside the box adjacent to the box ends 420. The front panel 406 of the box lid is folded over the front panel 428 of the box and the front flaps 408 are inserted into the pockets 41 0 between the first end panel 412 and the corner panels 426. Hand holes 405 in the top flaps 404 align with hand holes 424 in the box ends 412, 420 when the box 400 is closed. When the front flaps 408 are inserted into the locking pockets 410, the box lid will resist opening even if the loaded box is tipped or inverted during handling.

The folding and locking construction of the box provides a box that is strong and rigid. This allows a number of loaded boxes to be safely stacked for storage while supporting the weight of the packaged item such as ridge covers. The weight is supported by the sides and ends of the box. The enclosed items do not bear the weight of boxes stacked on top. Packaging ridge covers in a manner that allows the ridge covers to support the weight of material stacked on top tends to flatten and crack the ridge covers.

Figure 12:
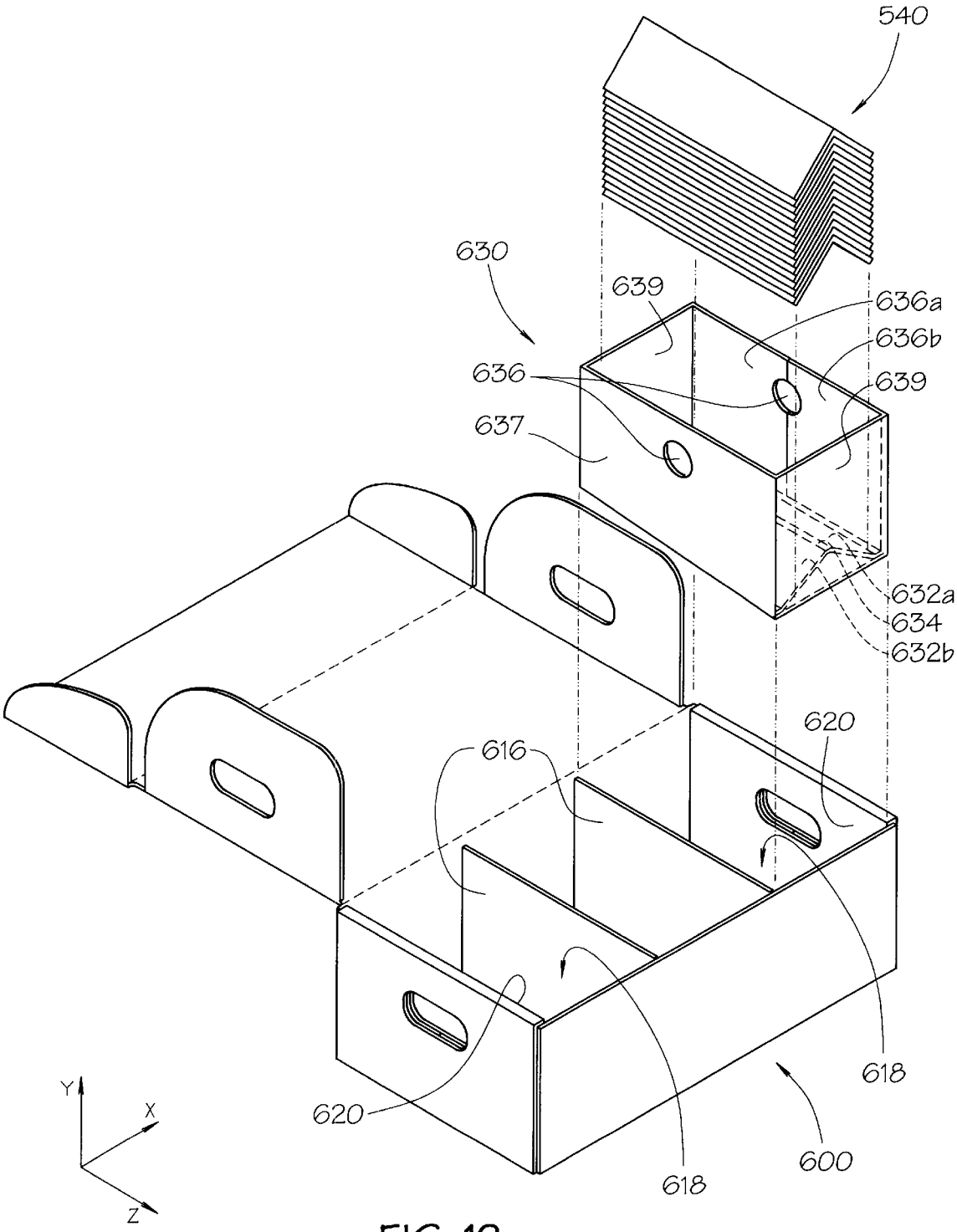
FIG. 12 is an exploded view of another embodiment of a packaging box with two fixed partitions according to the present invention with a stack of folded ridge covers.

FIG. 12 shows another embodiment of the partition of the present invention used with a box 600 with wrapped ends and integral locking lid like the basic box 400 of the embodiment shown in FIG. 7. In this embodiment the first panel 616 of the partition assembly is attached to a panel 618 (not visible) adjacent to the bottom of the box and attached to the inside end panel 620 along the bottom edge. The first partition panel 616 is constrained to rotate about the Z axis, around the folded edge connected to the panel 618 adjacent to the bottom of the box. In this respect this embodiment is similar to the embodiment shown in FIG. 1.

Partition assemblies 630 are inserted into the three compartments formed by the two first partition panels 616. The partition assemblies 630 are in the form of collars around the perimeter of each compartment. Each partition assembly includes at least one second panel 637 that cooperates with the first partition panel 616 to form a fixed partition as previously described. Preferably each partition assembly 630 includes two second panels 637 so that the same partition assembly can be used in any compartment. In this way each partition is formed from 3 panels, a first panel 616 and end panels 636 on each side of the first panel. The partition assemblies are substantially fixed with regard to rotation about the Z axis, particularly when the lid of the box is closed, and thus fix the first panel 616 in place.

A partition assembly 630 for a packaging box intended to be used for asphalt composition ridge covers may provide a ridge support structure. FIG. 12 shows a ridge support structure including two support panels 632*a*, 632*b* joined along a ridge line 634. The forward end panel 639 has been drawn to reveal the support structure with dashed lines. The second panel 636 to the left has been drawn as solid and the support structure behind is not shown.

Figure 13:
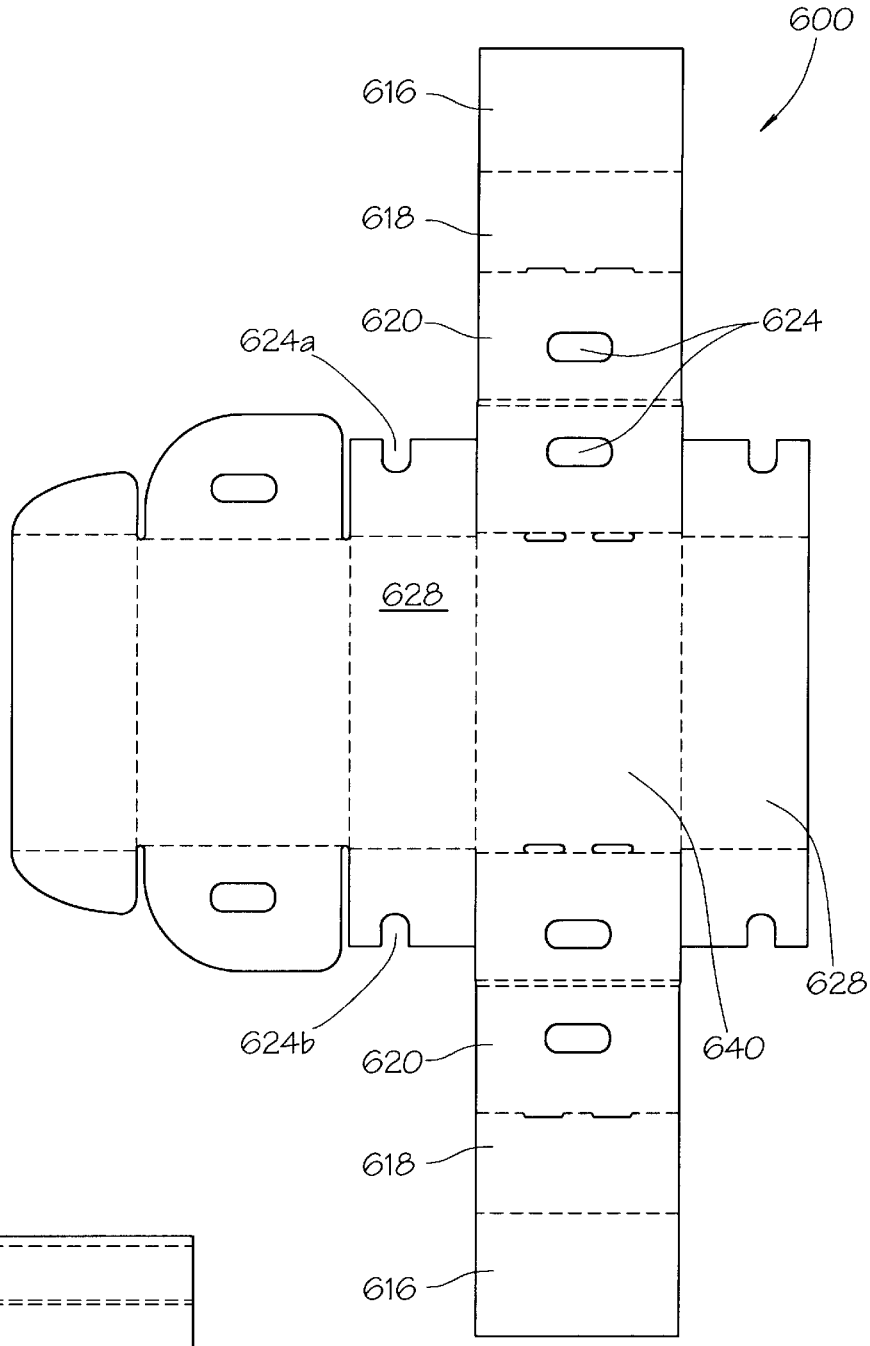
FIG. 13 is a plan view of the packaging box of FIG. 12 prior to folding.

FIG. 13 shows a plan view of the packaging box 600 of FIG. 12 as it may be cut from a single sheet of material, preferably corrugated cardboard. The assembly of this box 600 is substantially the same as previously described for the box 400 of FIG. 10. However, before folding the third end panel 620 down into the box, the partition support panel 618 is folded to be substantially perpendicular to the third end panel 620 so that it lies against the bottom 640 of the box 600. The first partition panel 616 is folded to be substantially perpendicular to the bottom 640 and to the two sides 628 of the box.

Figure 14:
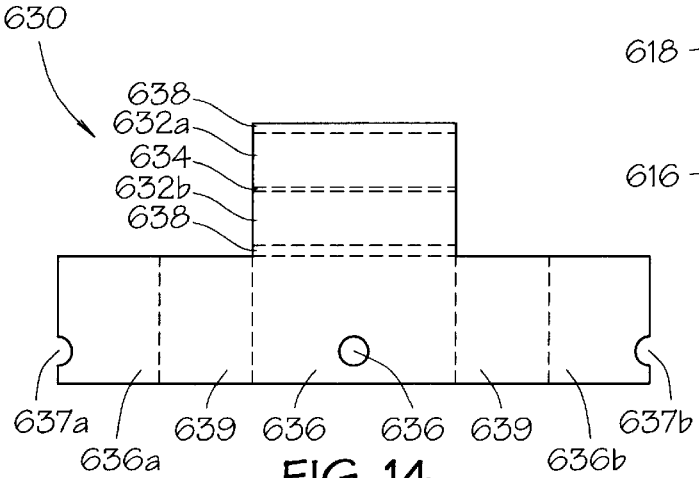
FIG. 14 is a plan view of the partition insert of FIG. 12 prior to folding.

FIG. 14 shows a plan view of a partition assembly 630 that includes a support structure as it may be cut from a single sheet of material, preferably corrugated cardboard. The assembly 630 is cut along the solid lines and folded along the dashed lines to form bottom panels 638 that rest against the bottom 640 of the box 600. The assembly 630 is folded along the ridge line 634 to form a ridge support from the two support panels 632*a*, 632*b* to support the ridge covers in their formed shape. A double score may be used for the ridge line 634 as shown to provide a more rounded ridge support. The full end panel 636 is folded to be substantially perpendicular to the bottom panels 638. The adjacent panels 639 are folded to be substantially perpendicular to the full end panel 636. The two partial end panels 636*a*, 636*b* are folded to be substantially perpendicular to the respective adjacent panels 639 to form a complete enclosure.

The folded assemblies 630 are placed in the box to complete the partitions. The two end panels 636 are substantially identical so that either panel may serve as a second partition panel, although, as shown, one of the end panels 636*a*, 636*b* may be formed from two sub-panels. It will be appreciated that both end panels 636 might be full panels and the joint in the partition assembly might fall in one of the adjacent panels 639 or in a corner between panels in other embodiments (not shown). Both panels serve as a second partition panel for the assembly placed in the center compartment of the box 600. The direction of the corrugations in the first partition panel 616 is preferably perpendicular to the direction of corrugations in the end panels 636 to provide more stiffness in the partitions. It is also preferable that the corrugations of the assembly 630 be perpendicular to the ridge line 634 to provide more stiffness in the support panels 632*a*, 632*b* that support the ridge covers. Holes 637 may be provided in the end panels 636. These holes align with hand holes 624 in the end of the box 600 and allow the contents of the box to be observed.

There has thus been provided a novel partition for a packaging box useful for folded ridge cover roofing. While the description of the preferred embodiment has been with specific reference to FIGS. 1–14, it should be understood that various modifications, additions and substitutions may be made to the structure and method of the invention without departing from the spirit and scope of the invention as defined in the appended claims. For example, the packing box may be used for any article that is similar is shape to a ridge cover, which is generally an angled channel. The material may be corrugated cardboard or any other material that can be formed in the manner required by the design of the box and insert. The box may be of the same or different materials from the insert. The invention is limited only by the appended claims.

What is claimed is:

1. A partition for a packaging box having a bottom, two opposing sides, and two opposing ends, the partition comprising:

a first panel located between and substantially parallel to the ends, between and substantially perpendicular to the sides, and substantially perpendicular to the bottom, the first panel having a first surface and an opposing second surface;

a second panel joined to the box along a fourth fold line and joined to the first panel along a first fold line;

a third panel having a third surface located immediately adjacent the first surface of the first panel; and a fourth panel joined to the third panel along a second fold line that is substantially perpendicular to the first fold line.

2. The partition of claim 1 further comprising:

a fifth panel having a fourth surface located immediately adjacent the second surface of the first panel; and a sixth panel joined to the fifth panel along a third fold line that is substantially perpendicular to the first fold line and substantially parallel to the second fold line.

3. The partition of claim 2 further comprising:

a seventh panel that is substantially co-planar with the first panel; and an eighth panel joined to the box and joined to the seventh panel along a third fold line that is spaced apart from and substantially parallel to the first fold line.

4. The partition of claim 1 where the fourth panel includes a ridge support to support asphalt composition ridge covers in their folded configuration, the ridge support further comprising two support panels, each support panel having a first side resting against the bottom of the packaging box, and a second side, opposite the first side, joined along a ridge line substantially above the bottom of the packaging box.

5. The partition of claim 1 where the fourth fold line is parallel to and substantially in the plane of the bottom of the box.

6. The partition of claim 1 where the fourth fold line is parallel to and substantially in the plane of the side of the box.

7. The partition of claim 6 further comprising:

a seventh panel that is substantially co-planar with the first panel; and an eighth panel joined to the box along a fifth fold line that is parallel to and substantially in the plane of the opposing side of the box and joined to the seventh panel along a third fold line that is spaced apart from and substantially parallel to the fourth fold line.

8. A fixed partition assembly for a packaging box having a bottom, two opposing sides, and two opposing ends, the fixed partition assembly comprising:

a first partition means for partitioning the box at a fixed position along a first fixed edge of the first partition means, the first partition means joined to the packaging box along a fourth fixed edge parallel to the first fixed edge; and a second partition means for partitioning the box at a fixed position a along a second fixed edge of the second partition means, the second fixed edge being substantially perpendicular to the first fixed edge;

wherein the first and second fixed edges define a plane of the fixed partition assembly.

9. The fixed partition assembly of claim 8 further comprising a third partition means for partitioning the box at a fixed position along a third fixed edge of the third partition means, the third fixed edge being spaced apart from and substantially parallel to the second fixed edge.

10. The fixed partition assembly of claim 9 wherein the first partition means further comprises a fourth fixed edge opposite the first fixed edge.

11. The fixed partition assembly of claim 8 further comprising a ridge support means for supporting asphalt composition ridge covers in a folded configuration that requires minimal bending during later installation.

12. The fixed partition assembly of claim 8 further comprising a third partition means for partitioning the box at a fixed position along a third fixed edge of the third partition means, the third fixed edge being spaced apart from and substantially parallel to the second fixed edge.

13. A packaging box comprising:

a bottom;

two opposing sides coupled to the bottom;

two opposing ends coupled to the bottom and the two sides; and a partition, the partition further comprising a first panel located between and substantially parallel to the ends, between and substantially perpendicular to the sides, and substantially perpendicular to the bottom, the first panel having a first surface and an opposing second surface, a second panel joined to the box along a fourth fold line and joined to the first panel along a first fold line, a third panel having a third surface located immediately adjacent the first surface of the first panel, and a fourth panel joined to the third panel along a second fold line that is substantially perpendicular to the first fold line.

14. The packaging box of claim 13, wherein the partition further comprises:

a fifth panel having a fourth surface located immediately adjacent the second surface of the first panel; and a sixth panel joined to the fifth panel along a third fold line that is substantially perpendicular to the first fold line and substantially parallel to the second fold line.

15. The packaging box of claim 14, wherein the partition further comprises:

a seventh panel that is substantially co-planar with the first panel; and an eighth panel joined to the box and joined to the seventh panel along a third fold line that is spaced apart from and substantially parallel to the first fold line.

16. The packaging box of claim 13, where the fourth panel includes a ridge support to support asphalt composition ridge covers in their folded configuration, the ridge support further comprising two support panels, each support panel having a first side resting against the bottom of the packaging box, and a second side, opposite the first side, joined along a ridge line substantially above the bottom of the packaging box.

17. The packaging box of claim 13, where the fourth fold line is parallel to and substantially in the plane of the bottom of the box.

18. The packaging box of claim 13, where the fourth fold line is parallel to and substantially in the plane of the side of the box.

19. The packaging box of claim 13, wherein the partition further comprises:

a seventh panel that is substantially co-planar with the first panel; and an eighth panel joined to the box along a fifth fold line that is parallel to and substantially in the plane of the opposing side of the box and joined to the seventh panel along a third fold line that is spaced apart from and substantially parallel to the fourth fold line.

* * * * *